US007607957B1

(12) United States Patent
Ho et al.

(10) Patent No.: US 7,607,957 B1
(45) Date of Patent: Oct. 27, 2009

(54) POWER PLUG

(75) Inventors: Hsin-Tsung Ho, Tu-Cheng (TW); Chih-Ling Yang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/292,291

(22) Filed: Nov. 17, 2008

(51) Int. Cl.
*H01R 4/10* (2006.01)

(52) U.S. Cl. ..... 439/879; 439/750

(58) Field of Classification Search ..... 439/879, 439/881, 874, 891, 867, 750
See application file for complete search history.

(56) References Cited

U.S. PATENT DOCUMENTS 1,575,656 A * 3/1926 Stratford et al. ..... 439/879
1,836,503 A * 12/1931 Poole ..... 29/33.5
2,350,765 A * 6/1944 Johnson ..... 439/879
2,814,026 A * 11/1957 Broske ..... 439/868
2,968,787 A * 1/1961 Wootton ..... 439/750
3,381,261 A * 4/1968 Dekain ..... 439/787
3,409,857 A * 11/1968 Kinkaid et al. ..... 439/72
3,416,122 A * 12/1968 Kinkaid ..... 439/72
3,605,079 A * 9/1971 Schneider ..... 439/879
4,209,221 A * 6/1980 Chupak et al. ..... 439/848
4,238,640 A * 12/1980 Tweed et al. ..... 174/87
4,570,338 A * 2/1986 Ignatowicz ..... 29/845
5,375,317 A * 12/1994 Murakami et al. ..... 29/753
6,517,388 B1 * 2/2003 Croise et al. ..... 439/697
2002/0142677 A1 * 10/2002 Hosaka et al. ..... 439/874

* cited by examiner

*Primary Examiner*—T C Patel
*Assistant Examiner*—Harshad C Patel
(74) *Attorney, Agent, or Firm*—Rosenberg, Klein & Lee

(57) ABSTRACT

A power plug adapted for being assembled by a jig which defines a plurality of receiving holes therein and an engaging portion formed on each of the receiving hole, includes a main body defining a passageway and having a basic portion, a terminal received in the passageway and having a soldering piece extending out from the main body, a fixing element inserted into the passageway, a shell and a holding element. The basic portion defines a positioning portion on an outer surface thereof. The shell surrounds the main body and the basic portion extends out of the shell. The holding element has a surrounding portion clasping the shell. When the power plug is disposed in the receiving hole of the jig, the positioning portion is engaged with the engaging portion for preventing the power plug rotating in the receiving hole.

3 Claims, 2 Drawing Sheets

POWER PLUG

BACKGROUND OF THE INVENTION

1. Field of the Invention

The present invention relates to a power connector, and more particularly to a power plug.

2. The Related Art

A conventional power plug includes a substantially cylindrical main body. A recess is formed in the main body passing therethrough along the axis of the main body. A terminal is inserted and then fixed in the recess of the main body. The terminal has a soldering portion extending out from the main body for mounting a cable. The power plug may need a jig for facilitating assembly thereof. The jig defines a plurality of receiving holes therein. The power plug is inserted into the receiving hole to be assembled.

However, the cylindrical main body is easy to rotate in the receiving hole of the jig when the power plug is in assembly, which makes the assembly of the power plug awkward.

SUMMARY OF THE INVENTION

An object of the present invention is to provide a power plug which is easy to be assembled. The power plug is adapted for being assembled in a jig which defines a plurality of receiving holes therein and an engaging portion formed in the side of each receiving hole. The power plug includes a main body, a terminal, a fixing element, a shell, and a holding element. The main body defines a passageway passing therethrough along the axis of the main body. The main body has a basic portion which defines a positioning portion in an outer surface thereof. The terminal is received in the passageway of the main body and has a soldering piece extending out from the basic portion of the main body for being soldered with a cable. The fixing element is inserted into the passageway for fixing the terminal in the main body. The shell partially surrounds the main body and the basic portion of the main body extends out of the shell. The holding element has a surrounding portion clasping the shell and a holding arm for holding the cable therein.

When the power plug is disposed in the receiving hole of the jig for being assembled, the positioning portion is engaged with the engaging portion for preventing the power plug from rotating in the receiving hole, which is beneficial for the assembly of the power plug. And according to the position of the positioning portion, the position of the terminal inserted into the main body can be identified.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
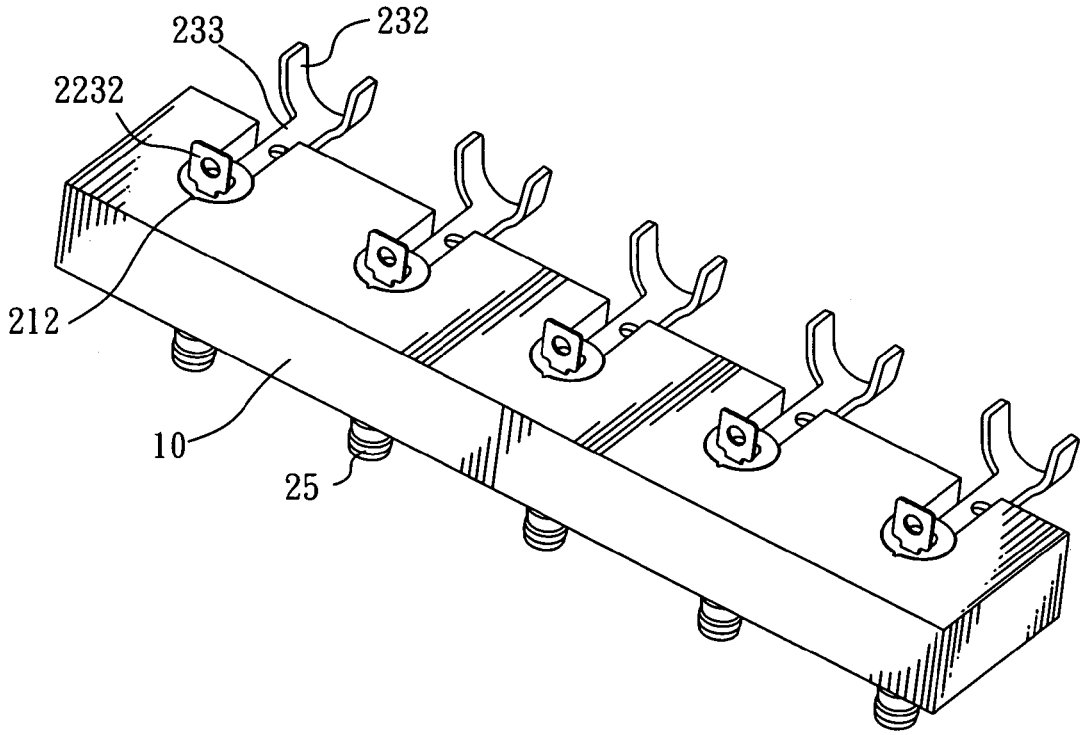
FIG. 1 is a perspective view of a combination of a set of power plugs according to the present invention and a jig used for assembling the power plugs.
Figure 2:
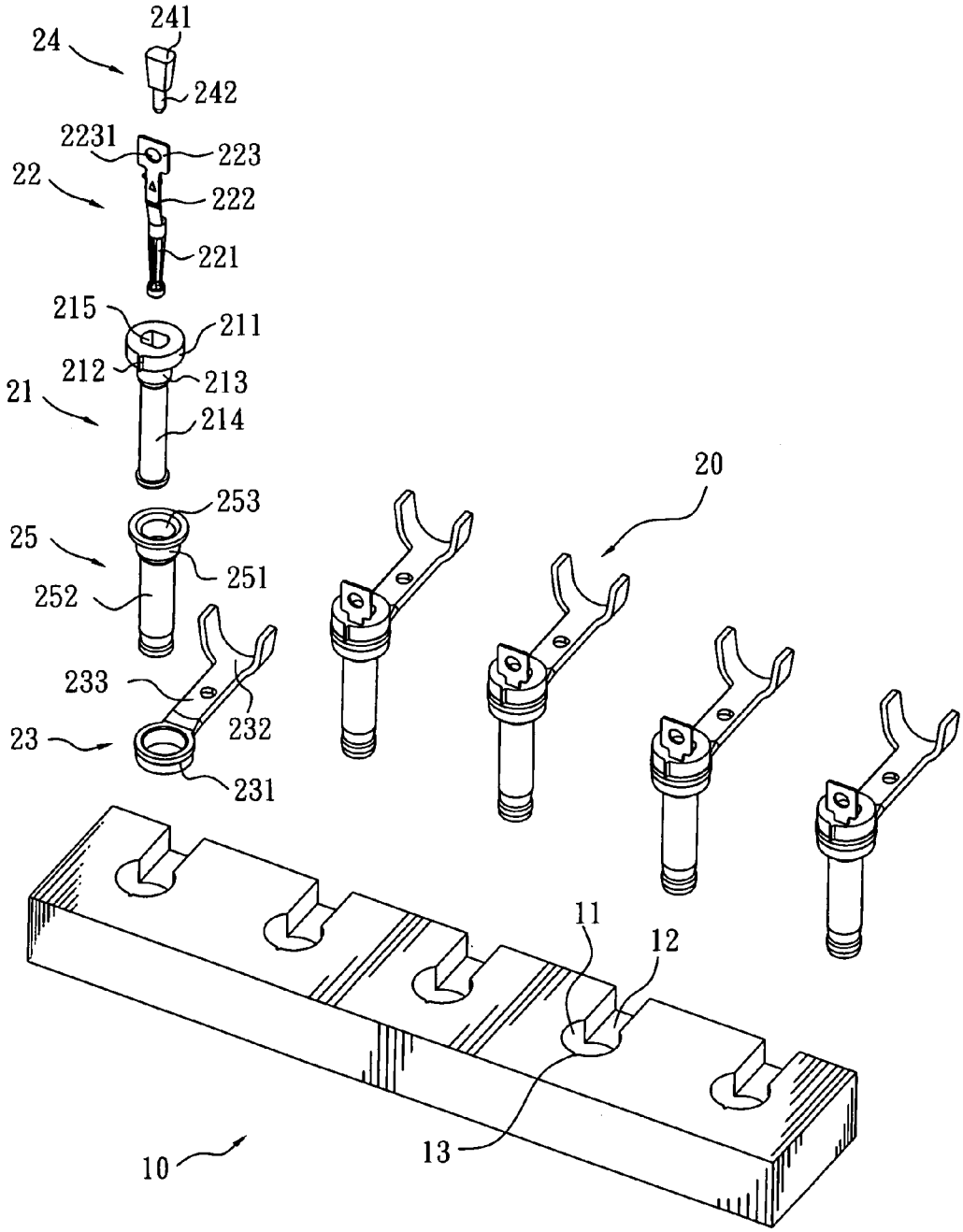
FIG. 2 is a perspective view of the power plugs and the jig shown in FIG. 1, wherein one of the power plugs is exploded.

With reference to FIG. 1 and FIG. 2, a power plug 20 according to the present invention and a jig 10 adapted for assembling the power plug 20 are shown. The jig 10 defines a plurality of receiving holes 11 passing through a top surface and a bottom surface thereof and a plurality of grooves 12 on the upper surface passing through a rear surface thereof and communicating with the respective receiving holes 11. An engaging portion 13 is recessed in the inner surface of each receiving hole 11.

The power plug 20 includes a main body 21, a terminal 22, a holding element 23, a fixing element 24, and a shell 25.

The main body 21 has a cylindrical basic portion 211. A portion of the outer circumference of basic portion 211 protrudes outward to form a tapering positioning portion 212. A connecting portion 213 of a cylindrical shape extends downward from a bottom surface of the basic portion 211 and an extending portion 214 of a cylindrical shape extends downward from a bottom surface of the connecting portion 213. The basic portion 211, the connecting portion 213 and the extending portion 214 are disposed coaxially and the diameters of them are gradually decreased in turn. A recess (not shown) is formed in the extending portion 214 passing therethrough. An inserting hole 215 is formed in an upper surface of the basic portion 211 and passes through the basic portion 211 and the connecting portion 213. The inserting hole 215 communicates with the recess and two opposite sides of the inserting hole 215 are arc-shaped. The recess and the inserting hole 215 compose a passageway.

The terminal 22 has a substantially cylindrical inserting portion 221. An elongated connecting piece 222 extends upward from an upper end of the inserting portion 221. A rectangular soldering piece 223 extends upward from a free end of the connecting piece 222 for being soldered with a cable (not shown). A soldering aperture 2231 is formed in a middle portion of the soldering piece 223.

The holding element 23 includes an annular surrounding portion 231, a U-shaped holding portion 232 and a connecting arm 233 connecting the surrounding portion 213 with the holding portion 232. The cable soldered with the soldering piece 223 is held in the holding portion 232.

The fixing element 24 includes a fixing portion 241 and an extending pillar 242 of a columnar shape extending downward from a bottom surface of the fixing portion 241. Two opposite sides of the fixing portion 241 are arc-shaped corresponding to the inserting hole 215.

The shell 25 includes an upper tubular portion 251 and a lower tubular portion 252 extending downward from a bottom portion of the upper tubular portion 251. The external diameter of the upper tubular portion 251 is bigger than that of the lower tubular portion 252. A cavity 253 is formed in the shell 25 and passes therethrough along the axis of the shell 25.

In assembly, firstly, the main body 21 is inserted into the cavity 253 of the shell 25, the connecting portion 213 and the extending portion 214 are respectively surrounded by the upper tubular portion 251 and the lower tubular portion 252, and the basic portion 211 extends out of the shell 25. Secondly, the surrounding portion 231 of the holding element 23 clasps the upper tubular portion 251 of the shell 25 and then the combination of the main body 21, the shell 25 and the holding element 23 is arranged in receiving hole 11 of the jig 10. More specially, the positioning portion 212 is engaged in the engaging portion 13 of the jig 10 and the connecting arm 233 is held in the groove 12. Thirdly, the terminal 22 is inserted into the main body 21. More specially, the inserting portion 221 and the connecting piece 222 is received passageway, the soldering piece 223 extends out of the main body 21, and the connecting piece 222 is disposed in one side of the inserting hole 215 adjacent to the positioning portion 212. At last, the fixing element 24 is inserted into the inserting hole 215 of the main body 21. The extending pillar 242 is inserted into the inserting portion 221 of the terminal 22 and the fixing portion 241 is received in the inserting hole 215 and fixes the connecting piece 222 in the inserting hole 215.

As the two opposite sides of the fixing portion 241 of the fixing element 24 are arc-shaped, the fixing element 24 is inserted into the inserting hole 215 more smoothly and the fixing element 24 is fixed in the inserting hole 215 more firmly.

As described above, the main body 21 of the power plug 20 according to the present invention defines the positioning portion 212 on the outer circumference of the basic portion 211, when the main body 21 is arranged in the receiving hole 11 of the jig 10, the positioning portion 212 of the main body 21 is engaged with the engaging portion 13 of the jig 10 for preventing the main body 21 from rotating in the receiving hole 11, which is beneficial for the assembly of the power plug 20. As the main body 21 is relative immovable in the receiving hole 11, the terminal 22 fixed in the main body 21 is relative immovable to the jig 10. So the assembly of mounting the cable to the terminal 22 is simply. And according to the position of the positioning portion 212, the position of the terminal 22 inserted into the main body 21 can be identified.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A power plug adapted for being assembled by a jig which defines a plurality of receiving holes therein and an engaging portion formed on each of the receiving holes, comprising:

a main body defining a passageway passing therethrough along the axis of the main body, the main body having a basic portion, a positioning portion formed on an outer surface of the basic portion;

a terminal received in the passageway of the main body, the terminal having a soldering piece extending out from the basic portion of the main body for being soldered with a cable;

a fixing element inserted into the passageway for fixing the terminal in the main body;

a shell partially surrounding the main body, the basic portion of the main body extending out of the shell; and a holding element having a surrounding portion for clasping the shell and a holding portion for holding the cable therein, wherein when the power plug is disposed in the receiving hole of the jig, the positioning portion is engaged with the engaging portion for preventing the power plug from rotating in the receiving hole.

2. The power plug as claimed in claim 1, wherein the positioning portion is protruded from the outer surface of the basic portion.

3. The power plug as claimed in claim 1, wherein the passageway includes an inserting hole defined in the basic portion, two opposite sides of the inserting hole are arc-shaped, the fixing element has a fixing portion fastened in the inserting hole, and two opposite sides of the fixing portion are arc-shaped corresponding to the inserting hole.

* * * * *